US007128556B2

(12) United States Patent
Wessells et al.

(10) Patent No.: US 7,128,556 B2
(45) Date of Patent: Oct. 31, 2006

(54) OBJECT FORMING AND LAUNCHING APPARATUS AND METHOD

(76) Inventors: Philip G. Wessells, 123 Cascade Dr., Mill Valley, CA (US) 94941; Andrew Lee Choy, 25 Chilton Ave., San Francisco, CA (US) 94131; Michael E. Woods, 89 Corte Cayuga, Greenbrae, CA (US) 94904

( * ) Notice: Subject to any disclaimer, the term of this patent is extended or adjusted under 35 U.S.C. 154(b) by 0 days.

(21) Appl. No.: 10/633,880

(22) Filed: Aug. 4, 2003

(65) Prior Publication Data

US 2005/0028800 A1 Feb. 10, 2005

(51) Int. Cl.
*B29C 33/26* (2006.01)
*F41B 3/04* (2006.01)

(52) U.S. Cl. ..... 425/276; 425/318; 124/5; 280/819; 279/129 K

(58) Field of Classification Search ..... 425/276, 425/277–286, 318, DIG. 57, 317; 124/5; 280/819–824; 273/129 K
See application file for complete search history.

(56) References Cited

U.S. PATENT DOCUMENTS

| | | | | | |
|---|---|---|---|---|---|
| 436,818 | A | * | 9/1890 | Pickering | 425/318 |
| 996,449 | A | * | 6/1911 | Bodenstein | 425/318 |
| 2,003,197 | A | * | 5/1935 | Jackson | 425/285 |
| 2,629,344 | A | * | 2/1953 | Maxwell | 425/280 |
| 2,948,275 | A | * | 8/1960 | Smith | 124/27 |
| 3,059,273 | A | * | 10/1962 | Blevins, Jr. | 425/318 |
| 3,472,217 | A | * | 10/1969 | Erickson | 124/5 |
| 3,685,942 | A | | 8/1972 | Shaffer | |
| 3,836,308 | A | * | 9/1974 | Upright | 425/318 |
| 4,163,639 | A | * | 8/1979 | Stern et al. | 425/318 |
| D268,037 | S | | 2/1983 | Wiseltier et al. | |
| 4,859,167 | A | * | 8/1989 | Maerz et al. | 425/276 |
| 5,000,153 | A | * | 3/1991 | Zimmerman et al. | 124/5 |
| 5,080,572 | A | | 1/1992 | Sage | |
| D323,772 | S | | 2/1992 | Sage | |
| D342,002 | S | | 12/1993 | Sage | |
| 6,076,829 | A | | 6/2000 | Oblack | |
| D484,938 | S | | 1/2004 | Tu | |

OTHER PUBLICATIONS

Abstract for DE 20300813U1, undated.*
Merriam-Webster's Collegiate Dictionary, 10th ed., p. 941 (1998).*

* cited by examiner

*Primary Examiner*—Donald Heckenburg
(74) *Attorney, Agent, or Firm*—Patent Law Office-MEW

(57) ABSTRACT

Disclosed is an apparatus, including a shaft; a scoop, coupled to a distal end of the shaft, for collecting and holding a bolus of a compressible medium, the compressible medium retaining a post-compressed shape when operated from a proximal end of the shaft; and a former, coupled to the scoop and mating with the scoop, for molding and compressing the bolus into a generally spherical ball retained within the scoop. A method for forming a throwable ball, includes scooping a bolus of a compressible medium with a scoop coupled to a distal end of a shaft, the compressible medium retaining a post-compressed shape; and molding compressively the bolus into the scoop using a former coupled to the distal end, wherein the molding step creates the ball retained in the scoop when a user operates a proximal end of the shaft.

15 Claims, 4 Drawing Sheets

OBJECT FORMING AND LAUNCHING APPARATUS AND METHOD

BACKGROUND OF THE INVENTION

The present invention relates generally to an object launcher, and specifically to a single-handed device for engaging the object with the launcher, and more specifically to forming and throwing a snowball using the same apparatus, and most specifically to single-handedly forming a snowball using an apparatus and thereafter using the apparatus to launch the snowball thereby formed.

The art and practice of molding snowballs is well-known. In the simplest embodiments, a person gathers a suitable quantity of snow into her hands and compresses and molds the gathered snow into a ball. The person then may throw it without it "breaking up" because the compressive formation creates a solid snowball. Without the compression, the handful of snow cannot be thrown very far.

There are a couple of disadvantages to the prior art. One is that the person must use his hands to gather and compress the snow. Because the snow is cold and compressing the snow results in a certain amount of melting, the person's hands quickly become wet and cold, often limiting the duration of snowball making and throwing activities. In particularly cold weather, there may be some personal health risk to extended periods of snowball manufacture.

A second disadvantage is that snow varies widely in its density and nature. Some snow requires a great deal of compressive force to form into suitable snowballs. Other snow may be particularly icy and difficult to gather. Snow having nearly ideal conditions for hand formation is not always available, and the quality and duration of snowball formation and throwing activities again may be limited.

The prior art has developed a device to aid in snowball formation. An example of such a device is shown in U.S. Pat. No. 5,080,572 entitled "SNOW BALL MAKING DEVICE" that issued on 14 Jan. 1992. The abstract of the patent describes the device:

> A snow ball making device is provided which includes a pair of elongated arms each of which has a first handle end and a second working end. These arms are pivotally secured to each other at a location intermediate their first and second ends, preferably within angled portions which connect longitudinally spaced parallel portions of the respective arms. The working end of each arm is provided with an open semi-spherical cup portion, such that the handle ends of the elongated arms are manipulable to move the semi-spherical cup portions between open and closed positions. In the closed position, the open semi-spherical cup portions are in flush engagement so as to insure the formation of a substantially spherical snow ball.

This device operates by gathering snow into the two semi-spherical cup portions and operating the two handles using one hand per handle. Operating the handles compresses the snow and forms it into a "substantially spherical" snow ball. The user removes the ball for use. While the device overcomes some disadvantages of using one's hands, there remain disadvantages to using it. These disadvantages include finding a way for the device not to interfere or get lost while throwing the snow ball, and the user is still left with handling the cold, wet snow ball with her hands during throw preparation and launch.

What is needed is another solution to snow ball formation that overcomes some of the disadvantages of the prior art while preserving the benefits.

SUMMARY OF THE INVENTION

Disclosed is an apparatus, including a shaft; a scoop, coupled to a distal end of the shaft, for collecting and holding a bolus of a compressible medium, the compressible medium retaining a post-compressed shape when operated from a proximal end of the shaft; and a former, coupled to the scoop and mating with the scoop, for molding and compressing the bolus into a generally spherical ball retained within the scoop. A method for forming a throwable ball, includes scooping a bolus of a compressible medium with a scoop coupled to a distal end of a shaft, the compressible medium retaining a post-compressed shape; and molding compressively the bolus into the scoop using a former coupled to the distal end, wherein the molding step creates the ball retained in the scoop when a user operates a proximal end of the shaft. A method for throwing a snow object, including operating a proximal end of a shaft having a snow object maker coupled to a distal end of the shaft to gather a bolus of snow into the snow object maker, the snow object maker having a scoop, coupled to the distal end, for receiving the bolus into a first concave portion, the first concave portion directed away from an operator when the proximal end is held for operation; and a former, operatively coupled to the scoop, for compressively molding the bolus into the throwable object by selectively engaging a second concave portion of the former with the bolus received into the first concave portion; molding the bolus into the throwable object by manipulation of the proximal end to operate the former; and swinging the shaft through an arc by operating the proximal end to launch the throwable object from the first concave portion.

The preferred embodiment permits a user to single-handedly gather snow, form the gathered snow into a ball, and throw the ball, all without ever touching the snow or ball with the user's hand or hands. Periods for snowball-related activities are able to be extended, user's are enabled to throw bigger snowballs greater distances for longer periods of time. One of the user's hands may be available for other actions/uses while making and throwing snowballs using the device. New activities are enabled using the preferred embodiment, such as for example, snowball-making/throwing activities while sledding, skiing, boarding, skating and the like. The device may be incorporated into available sport implements (e.g., a ski pole) or used as an adjunct to the tools of the sport.

These and other novel aspects of the present invention will be apparent to those of ordinary skill in the art upon review of the drawings and the remaining portions of the specification.

DESCRIPTION OF THE SPECIFIC EMBODIMENTS

The present invention relates to an object launcher, and specifically to a single-handed device for engaging the object with the launcher, and more specifically to forming and throwing a snowball using the same apparatus, and most specifically to single-handedly forming a snowball using an apparatus and thereafter using the apparatus to launch the snowball thereby formed. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
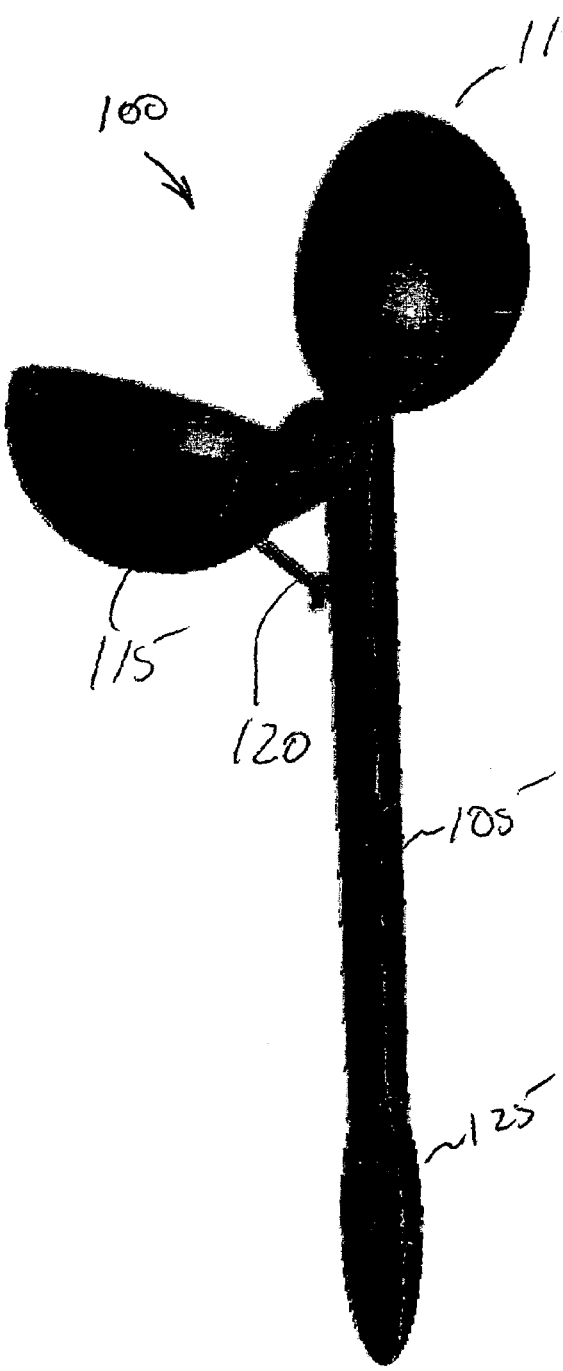
FIG. 1 is a perspective view of a preferred embodiment for an object forming and launching system in a launching mode.

FIG. 1 is a perspective view of a preferred embodiment for an objectizing and launching system 100 in a launching mode. System 100 includes a shaft 105, a scoop 110, a former 115 coupled to scoop 110 and a biasing system 120 for inducing former 115 into an open position. Alternately, former 115 may be coupled to shaft 105 or other structure to achieve the desired relationship between scoop 110 and former 115. As used herein, the term objectizing includes an act or acts of gathering, collecting, selecting, forming, shaping, grabbing and/or creating an object from one or more objects or media. Alternately, former may be coupled to shaft 105

Shaft 105 is constructed sufficiently rigid and flexible for the intended application, but preferably is constructed of a solid molded plastic or extruded aluminum tube body having about eighteen to about thirty inches of length. Shaft 105 has a proximal end and a distal end, and includes a handle 125 at the proximal end and scoop 110 coupled at the distal end. In some implementations and embodiments, shaft 105 has a variable length and/or a variable flexibility resulting from telescoping elements or from mutually cooperating elements that otherwise slide relative to each other. A variable length shaft is useful for adapting system 100 for use by users of different heights, among other advantages, while the variable flexibility shaft is useful for adapting system 100 to different conditions for objectizing and launching objects. Generally, as the flexibility of shaft 105 increases, objects may be launched greater distances. However, as shaft 105 also supports the collecting of an object, as the flexibility of shaft decreases, objects are often easier to be collected.

Scoop 110 serves as a preferred objectifier, which in the preferred embodiment includes collecting and holding a bolus of a compressible medium. This compressible medium includes snow or other substance that is able to be formed and shaped into a ball that retains its shape after forming/shaping. Scoop 110 may also select a single item from a collection of items and retain it within a cavity. The cavity of scoop 10 is preferably one-half of a sphere that holds the bolus after it is collected. Scoop 110 may be inclined relative to a longitudinal axis of shaft 105. Inclination of scoop 110 is adapted to assist in objectizing and for launching objects from within the cavity.

In some embodiments and implementations, scoop 110 is coupled to shaft 105 using a mounting system that permits different lengths of shaft 105 to be used in cooperation with scoop 110. For example, a threaded end at the distal end of shaft 105 may be used to mount to complementary threaded portion in scoop 110. Additionally, the mounting system may provide for varying the inclination angle according to a user preference.

Former 115 is a mating element cooperating with scoop 110 for objectizing an object or medium. In the preferred embodiment, former 115 includes a spherical cavity matching the cavity in scoop 110 for use as a compactor/former/shaper of the bolus. Former 115 includes two positions relative to scoop 110, a closed position and an open position. In the closed position, former 115 compresses the bolus and presses it into scoop 110 to form a generally spherical ball of the compressible medium (e.g., a snowball). In the open position after ball formation, the ball is retained within scoop 110 and former 115 pivots down and away from scoop 110. In the open position, former 115 does not interfere with a launching of the ball from scoop 110 when shaft 105 is swung in an arc about handle 125. Former 115 is also positioned relative to scoop 110 and shaft 105 to permit former 115 to be operated from single-handed manipulation of handle 125, such as, for example, tapping former 115 against the ground or other object or structure to move former 115 from the open position to the closed position.

In the preferred embodiment when scoop 110 and former 115 define matching semi-spheres, the closed position juxtaposes the two structures together sufficiently to form the bolus into the desired shape. This juxtaposition need not be completely closed, or even in some cases mostly closed. The degree of closure depends upon the nature and condition of the compressible medium and the user's desire to collect, shape and form balls of varying quality. Typically, the "best" balls are formed when scoop 110 and former 115 are completely closed, but these "best" balls may be perceived to require extra time to form by completely closing the elements. Balls of lesser quality (produced from less proximate juxtapositions) may be produced faster, thus more balls per unit of time may be launched.

In other embodiments, former 115 is a trapper that simply retains an object within the cavity of scoop 110 while the object is collected. Scoop 110 and former 115 are preferably molded plastic semi-spheres, though other shapes and materials may be used. In some conditions, scoop 110 may require extra stiffness and/or use of a cutting edge along all or a portion of a periphery of the cavity to efficiently collect sufficient quantities of the compressible medium.

Biasing system 120 of the preferred embodiment includes an elastomeric band coupled between former 115 and shaft 105 to bias former 115 into the open position. The elastomeric band is replaceable and preferably provides a sufficient biasing force to maintain former 115 in an open or semi-open position so as to not interfere with a launch of an object from within a cavity of scoop 110. In some configurations, former 115 will tend to the closed position as shaft 105 is swung through the arc, and that tendency is increased as shaft 105 becomes longer or the speed of the swing or of scoop 110 increases. Other biasing systems may be used, to pull, push or otherwise separate former 115 from scoop 110 and induce former 115 into the open position.

Figure 2:
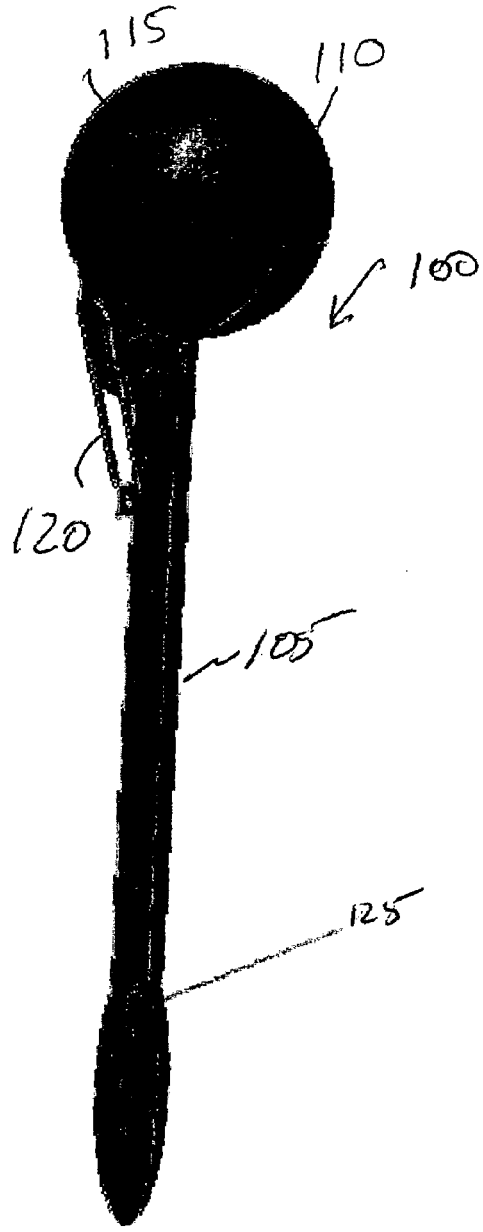
FIG. 2 is a perspective view of the object forming and launching system shown in FIG. 1 in a forming mode.

FIG. 2 is a perspective view of objectizing and launching system 100 shown in FIG. 1 in a forming mode. System 100 enters the forming mode by manipulation of handle 125, and such manipulation may be performed using a single hand. This is in contrast to prior art systems that require a user to use two hands in operating the device. To enter the forming mode, system 100 juxtaposes former 115 to scoop 110. In the preferred embodiment, this juxtaposition is achieved by rotating former 115 relative to scoop 110, though other implementations may use a different configuration. Also, former 115 is shown pivotally coupled to shaft 105 so that the former moves "up" and "down" when shaft 105 is vertical. Former 115 may be configured to move (e.g., pivot) "side" to "side" or some other relative orientation when shaft 105 is vertical.

In operation, a user operates system 100 through single-handed manipulation of handle 125. The user collects the bolus of the compressible medium (e.g., snow) into scoop 110. In some instances, the collection is achieved by scooping up a sufficient quantity to overflow the cavity of scoop 110, and in other instances, scoop 110 is plunged into a large quantity of the medium, or former 115 is used as a "plow" to produce a suitable pile of medium that may be collected by scoop 110.

The user then manipulates handle 125 to cause former 115 to be juxtaposed sufficiently to scoop 110 to form the desired shape and consistency ball. The user achieves this by urging former 115 against the ground, building, other structure or other object to move it towards the closed position. In the preferred embodiment, it is accomplished by "tapping" former 115 against the ground to compress/pack and form the desired ball.

Releasing the closing force permits biasing system 120 to move former 115 to the open position. This retains the ball within the cavity of scoop 110. The user may then, when desired, swing shaft 105 about an arc to launch the ball from the cavity of scoop 110 towards the desired target. System 100 is ready to collect and form other balls in quick succession.

Figure 3:
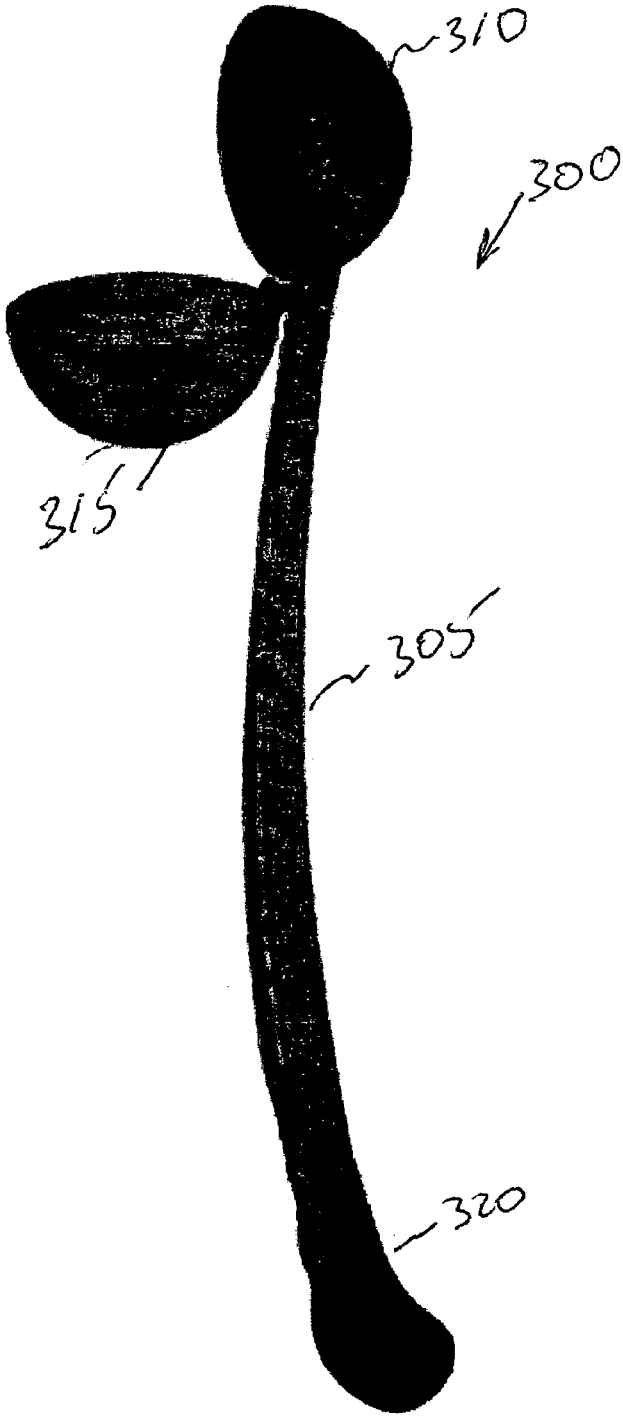
FIG. 3 is a perspective view of a first alternate preferred embodiment for an object forming and launching system in a launching mode.
Figure 4:
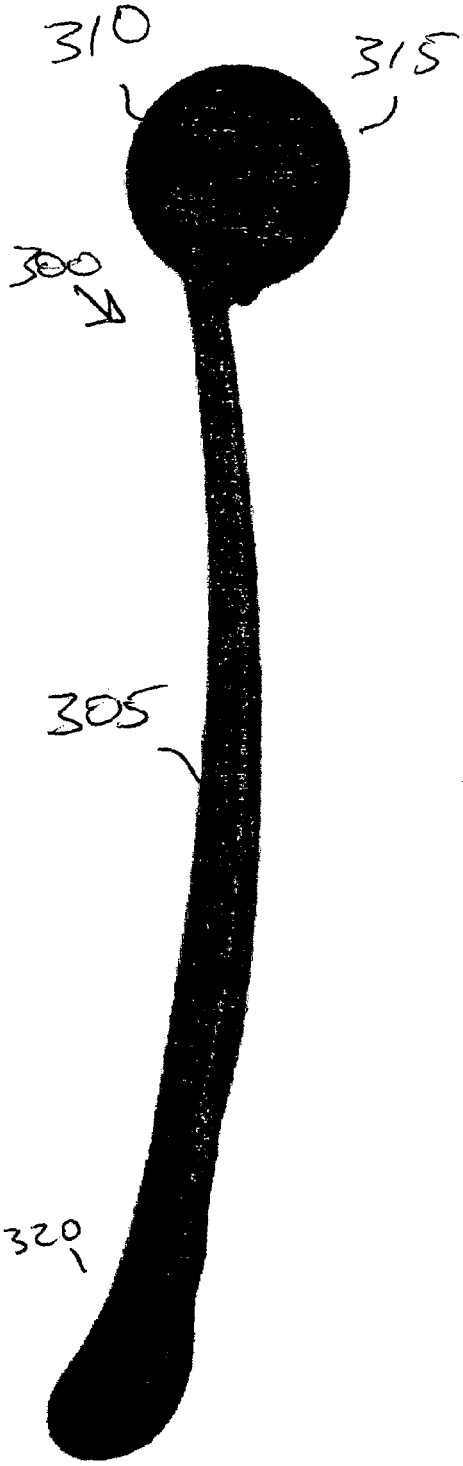
FIG. 4 is a perspective view of the object forming and launching system shown in FIG. 3 in a forming mode.

FIG. 3 is a perspective view of a first alternate preferred embodiment for an objectizing and launching system 300 in a launching mode. System 300 includes a shaft 305, a scoop 310 at a distal end of shaft 305, a former 315 coupled to scoop 310 and a handle 320 integrated into a proximal end of shaft 305. System 300 is similar to system 100, modified as described below. Shaft 305 is curved in a backward arch from handle 320 to scoop 310. Former 315 is pivotally coupled to shaft 305 or scoop 310 using a spring-loaded hinge that serves as a biasing system for system 300. FIG. 4 is a perspective view of objectizing and launching system 300 shown in FIG. 3 in a forming mode.

Figure 5:
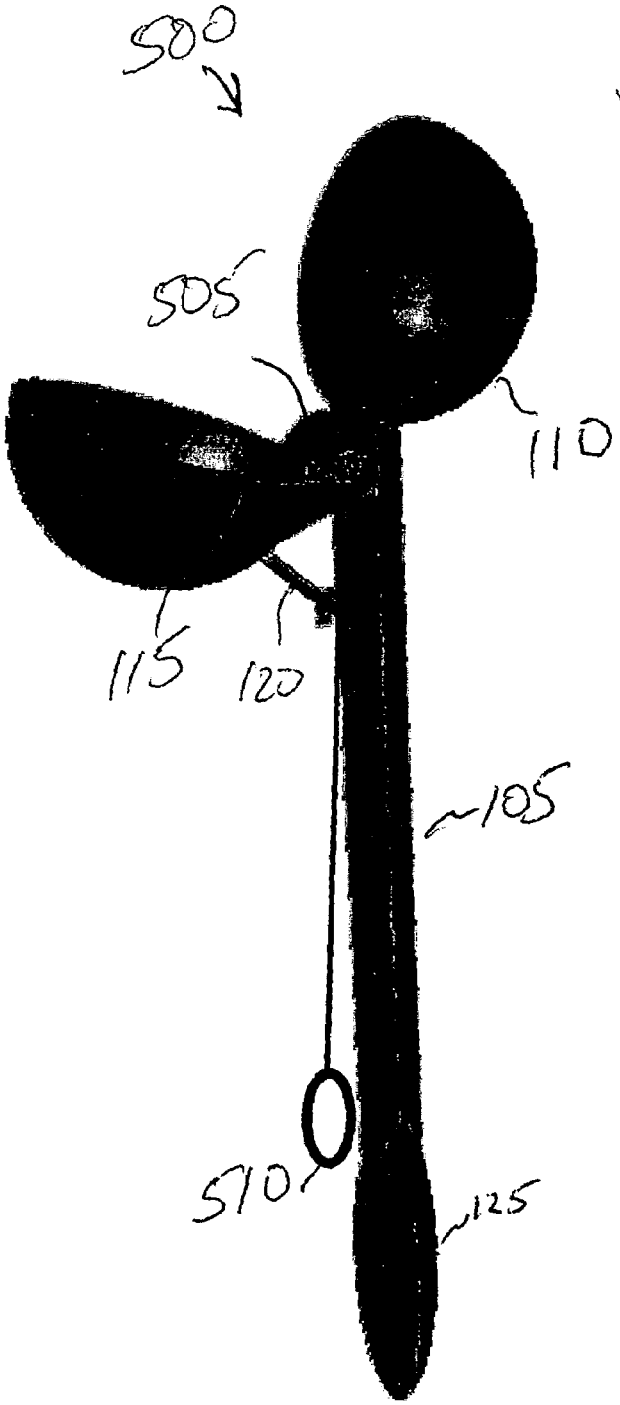
FIG. 5 is a perspective view of a second preferred embodiment for an object collecting and launching system in a launching mode.

FIG. 5 is a perspective view of a second alternate preferred embodiment for an objectizing and launching system 500 in a launching mode. System 500 is configured similarly to system 100 shown in FIG. 1 and FIG. 2 with the addition of a latching mechanism 505 and a release 510. Latching mechanism 505 is a hinged system that releasably locks when former 115 is sufficiently "closed" relative to scoop 110. Latching mechanism 505 is responsive to release 510 to stop inhibiting the return of former 115 to the open position. Release 510 is preferably a cable, chain, wire or other connector coupled to ring mounted near handle 125.

Figure 6:
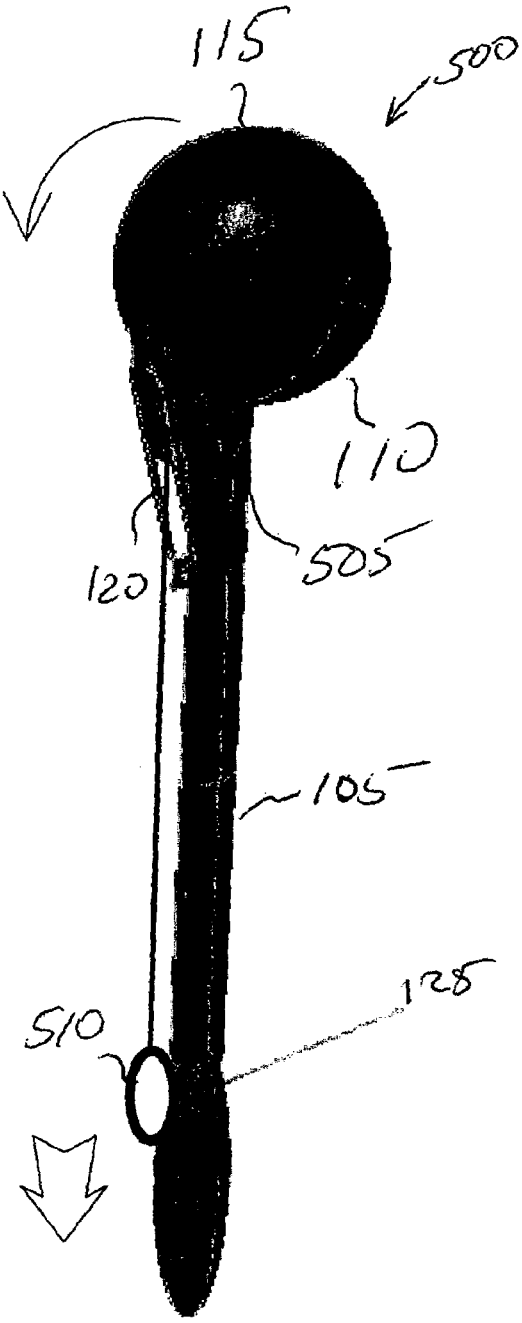
FIG. 6 is a perspective view of the object forming and launching system shown in FIG. 5 in a retaining mode.

In operation, when former 115 is moved sufficiently close to activate latching mechanism 505. Thereafter, former 115 does not open to permit launching of an object in scoop 110 until release 510 is actuated. In this configuration, the user would actuate release 510 immediately prior to launch. In this configuration, system 500 may be used to launch virtually any object that fits within scoop 110 and former 115. FIG. 6 is a perspective view of the objectizing and launching system shown in FIG. 5 in a retaining mode.

Figure 7:
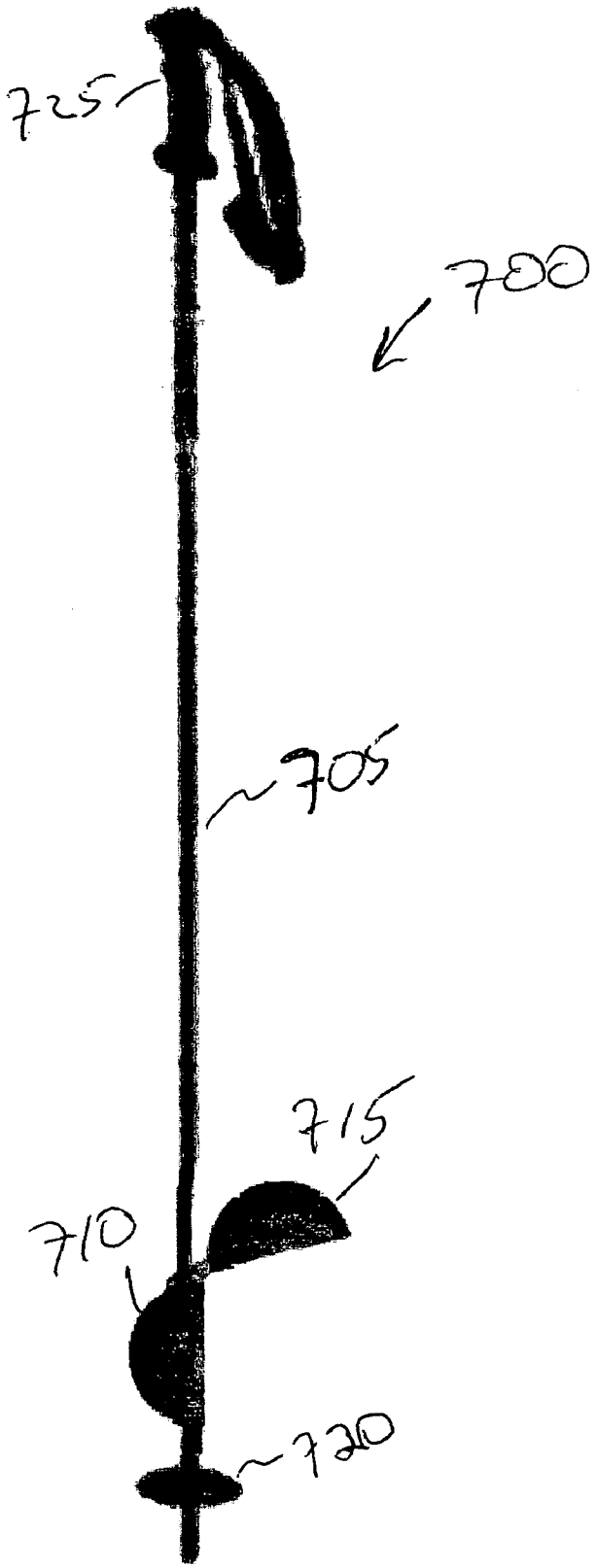
FIG. 7 is a perspective view of a third alternate preferred embodiment for an object forming and launching system in a launching mode.
Figure 8:
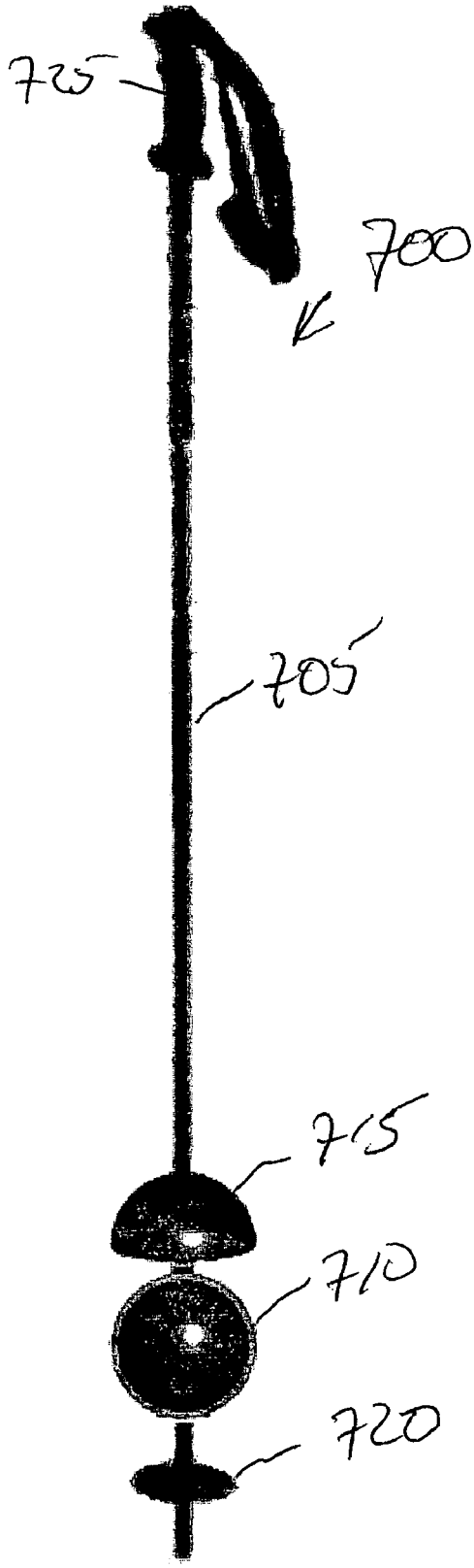
FIG. 8 is a perspective view of the object forming and launching system shown in FIG. 7.

FIG. 7 is a side perspective view of a third alternate preferred embodiment for an objectizing and launching system 700 in a launching mode. System 700 is integrated into another sporting implement, in this instance, a ski pole. System 700 includes a shaft 705, a scoop 710, a former 715, a snow basket 720 and a handle 725 components as shown in FIG. 1 through FIG. 6 as described above. FIG. 8 is a front perspective view of the objectizing and launching system shown in FIG. 7.

Scoop 710 is shifted relative to shaft 705 to enable scooping without interfering with the ski pole function. Shaft 705 need not be coupled to a "rim" of scoop 710, but could be attached nearly tangential to scoop 710. Similarly, former 715 may be desirably "side-mounted" to enable former 715 to be tapped closed without interfering with the ski pole functions. FIG. 8 illustrates that scoop 710 may be integrated into shaft 705 and serve as a structural element. Further, scoop 710 may be provided with a latching mechanism and release system as described above. In some implementations, scoop 710 is incorporated into the snow basket 720.

The above-described arrangements of apparatus and methods are merely illustrative of applications of the principles of this invention and many other embodiments and modifications may be made without departing from the spirit and scope of the invention as defined in the claims.

These and other novel aspects of the present invention will be apparent to those of ordinary skill in the art upon review of the drawings and the remaining portions of the specification.

What is claimed is:

1. An apparatus, comprising:

a shaft having a gripping end and a distal end remote from said gripping end; and a shaper disposed at the distal end, said shaper including:

a scoop, fixed to the distal end of the shaft at an attachment location, including a first cavity collecting and holding a bolus of a compressible medium, the compressible medium retaining a post-compressed shape, the cavity generally semi-spherical and including an opening for receiving the bolus, the opening defining a plane generally disposed parallel to a longitudinal axis of the shaft; and a former including a second cavity cooperating with the first cavity, hingedly coupled to the shaft proximate the attachment location without extending into a second handle and mating with the scoop, cooperating with the scoop to mold and compress the bolus into a generally spherical ball retained within the shaper using single-handed operation, wherein the scoop and the former include opposing sections of a generally spherical shell, wherein the former includes an open position relative to the scoop and a closed position relative to the scoop, the former molding the bolus in the closed position, and wherein the former is biased to the open position.

2. The apparatus of claim 1 wherein the former is operable to the closed position by one-handed manipulation of a proximal end of the shaft.

3. The apparatus of claim 1 further comprising a latching mechanism, coupled to said former, for inhibiting said former from returning to said open position.

4. The apparatus of claim 3 further comprising a release, coupled to said latching mechanism and operable from said gripping end, for disengaging said latching mechanism and removing said inhibition of said former.

5. An apparatus, comprising:

a shaft having a gripping end and a distal end remote from said gripping end; and a shaper disposed at the distal end, said shaper including:

a scoop, coupled to the distal end of the shaft at an attachment location, including a first cavity for collecting and holding a bolus of a compressible medium, the compressible medium retaining a post-compressed shape; and a former including a second cavity cooperating with the first cavity, coupled to the scoop proximate the attachment location and mating with the scoop, for cooperating with the scoop for molding and compressing the bolus into a generally spherical ball retained within the shaper, wherein the shaft includes a ski pole.

6. The apparatus of claim 5 wherein ski pole includes a snow basket on the first distal end.

7. The apparatus of claim 6 wherein the scoop is part of the snow basket.

8. The apparatus of claim 7 wherein the scoop is part of the former.

9. An apparatus, comprising:

a shaft having a gripping end and a distal end remote from said gripping end; and a shaper disposed at the distal end, said shaper including:

a scoop, fixed to the distal end of the shaft at an attachment location, including a first cavity collecting and holding a bolus of a compressible medium, the compressible medium retaining a post-compressed shape, the cavity generally semi-spherical and including an opening for receiving the bolus, the opening defining a plane generally disposed parallel to a longitudinal axis of the shaft; and a former including a second cavity cooperating with the first cavity, hingedly coupled to the shaft proximate the attachment location without extending into a second handle and mating with the scoop, cooperating with the scoop to mold and compress the bolus into a generally spherical ball retained within the shaper using single-handed operation, wherein said shaft and said scoop are coupled together using a mating system, and wherein said mating system includes a threaded member coupled to one of said shaft and said scoop and a complementary member coupled to one of said shaft and said scoop.

10. An apparatus, comprising:

a shaft;

a scoop, fixed to a distal end of said shaft at an attachment location, for collecting and holding an object within a cavity, said cavity including an opening for receiving the object wherein said opening is defined generally within a plane and said plane is disposed generally parallel to a general longitudinal axis of said shaft;

a trapper, hingedly coupled to said shaft at said attachment location and mating with said scoop, for retaining said object within the scoop when in a closed position, said trapper biased to an open position wherein said object may be collected and/or released; and a latching mechanism, coupled to said trapper, for inhibiting said trapper from returning to said open position.

11. The apparatus of claim 10 further comprising a release, coupled to said latching mechanism and proximate to a proximal end of said shaft, for remotely disengaging said latching mechanism and removing said inhibition of said trapper.

12. An apparatus, comprising:

a shaft having a proximal end for gripping by a user during operation and a distal end remote from said proximal end; and a forming system disposed at said distal end at an attachment location, said forming system including:

a first forming element, fixed to said shaft at said attachment location, having a first cavity for collecting and shaping a bolus of snow; and a second forming element, moveably coupled to said shaft proximate said attachment location, having a second cavity mating with said first cavity cooperatively shaping said bolus of snow into a generally spherical ball using single-handed operation, wherein said first forming element includes an open position relative to said second forming element and a closed position relative to said second forming element, said forming system molding said bolus in said closed position, and wherein the forming system is biased to the open position.

13. The apparatus of claim 12 wherein the forming system is operable to the closed position by one-handed manipulation of said proximal end of the shaft.

14. The apparatus of claim 12 further comprising a latching mechanism, coupled to said forming system, for inhibiting said forming system from returning to said open position.

15. The apparatus of claim 14 further comprising a release, coupled to said latching mechanism and operable from said proximal end, for disengaging said latching mechanism and removing said inhibition of said forming system.

* * * * *